US009771231B2

(12) United States Patent
Pettersson

(10) Patent No.: US 9,771,231 B2
(45) Date of Patent: Sep. 26, 2017

(54) INFEED SYSTEM

(75) Inventor: Niklas Pettersson, Sandy, UT (US)

(73) Assignee: PACKSIZE LLC, Salt Lake City, UT (US)

( * ) Notice: Subject to any disclaimer, the term of this patent is extended or adjusted under 35 U.S.C. 154(b) by 1085 days.

(21) Appl. No.: 13/147,787

(22) PCT Filed: Feb. 3, 2010

(86) PCT No.: PCT/US2010/022983

§ 371 (c)(1),
(2), (4) Date: Sep. 16, 2011

(87) PCT Pub. No.: WO2010/091043

PCT Pub. Date: Aug. 12, 2010

(65) Prior Publication Data

US 2011/0319242 A1 Dec. 29, 2011

Related U.S. Application Data

(60) Provisional application No. 61/149,985, filed on Feb. 4, 2009.

(51) Int. Cl.
*B65H 16/00* (2006.01)

(52) U.S. Cl.
CPC ..... *B65H 16/00* (2013.01); *B31B 2201/0205* (2013.01); *B31B 2201/0282* (2013.01);
(Continued)

(58) Field of Classification Search
CPC ..... B65H 45/1015; B65H 2511/512; B65H 16/00; B65H 2404/1116;
(Continued)

(56) References Cited

U.S. PATENT DOCUMENTS 2,181,117 A * 11/1939 Brenn ..... B65H 45/12 493/324
3,628,408 A 12/1971 Rod et al.
(Continued)

FOREIGN PATENT DOCUMENTS

CN 1191833 9/1998
EP 0030366 6/1981
(Continued)

OTHER PUBLICATIONS

International Search Report and Written Opinion from International Application No. PCT/US2010/022983 dated Apr. 13, 2010.
(Continued)

*Primary Examiner* — Sameh Tawfik
(74) *Attorney, Agent, or Firm* — Workman Nydegger

(57) ABSTRACT

A system is described relating to the feeding of raw materials into a machine that converts the raw materials into a packaging template. The system may use raw packaging materials and supply the raw materials to a converting mechanism using an infeed wheel. The infeed wheel may rotate and have a number of edges that engage the raw materials. Raw materials of one form used may include fanfold material that has existing fold or score lines that define opposing boundaries of the fanfold material, but which allow separate layers to remain connected. As the infeed wheel rotates, the edges engage the raw materials, and can engage the existing fold or score lines. Some edges may engage at locations between existing fold or score lines, and can crease the raw materials.

28 Claims, 8 Drawing Sheets

(52) U.S. Cl.
CPC ... *B65B 2210/04* (2013.01); *B65H 2404/1116* (2013.01); *B65H 2701/1824* (2013.01); *B65H 2801/81* (2013.01)

(58) Field of Classification Search
CPC ..... B65H 2701/1824; B65H 2801/81; B65H 45/04; B31B 3/00; B31B 2201/0264; B31B 1/10; B31B 2201/0205; B31B 2201/0282; B31D 5/0043
USPC ... 493/126, 52, 122, 56, 160, 161, 162, 163, 493/164, 240, 241, 249, 251, 478, 403, 493/370, 59, 231, 396, 411, 413, 429, 493/430, 448, 405; 270/8, 39.01, 39.05, 270/39.06, 39.07, 39.08; 206/555, 556, 206/449; 400/613.2
See application file for complete search history.

(56) References Cited

U.S. PATENT DOCUMENTS

| | | | | |
|---|---|---|---|---|
| 3,743,154 | A * | 7/1973 | Brewitz | 226/113 |
| 4,094,451 | A | 6/1978 | Wescoat | |
| 4,264,200 | A | 4/1981 | Tickner et al. | |
| 4,838,468 | A * | 6/1989 | Lesse | B65H 27/00 226/76 |
| 5,058,872 | A * | 10/1991 | Gladow | 270/39.01 |
| 5,836,498 | A | 11/1998 | Turek | |
| 5,941,451 | A * | 8/1999 | Dexter | B42D 15/08 229/69 |
| 6,189,933 | B1 * | 2/2001 | Felderman | 283/34 |
| 6,840,898 | B2 | 1/2005 | Pettersson | |
| 7,100,811 | B2 | 9/2006 | Pettersson et al. | |
| 7,647,752 | B2 | 1/2010 | Magnell | |
| 2002/0125712 | A1 * | 9/2002 | Felderman | 283/34 |
| 2004/0060264 | A1 | 4/2004 | Miller | |
| 2005/0103923 | A1 * | 5/2005 | Pettersson et al. | 242/615.2 |
| 2008/0020916 | A1 | 1/2008 | Magnell | |
| 2009/0199527 | A1 * | 8/2009 | Wehr et al. | 55/521 |
| 2013/0210597 | A1 | 8/2013 | Pettersson | |

FOREIGN PATENT DOCUMENTS

| | | |
|---|---|---|
| EP | 0359005 | 3/1990 |
| GB | 1362060 | 7/1974 |
| JP | 5689937 | 7/1981 |
| RU | 2015030 | 6/1994 |
| SE | 450829 | 8/1987 |
| WO | 2010091043 | 8/2010 |
| WO | 2012003167 | 1/2012 |

OTHER PUBLICATIONS

International Search Report for PCT/US2011/042096 dated Oct. 28, 2011.
U.S. Appl. No. 13/147,787, filed Aug. 27, 2014, Office Action.
European Search Report for EP10739040 dated Jan. 31, 2013.
European Search Report for EP80107577.1 dated Feb. 3, 1981.
European Search Report for EP89115688.7 dated Feb. 11, 1989.
U.S. Appl. No. 13/805,602, filed Dec. 2, 2015, Office Action.

* cited by examiner

INFEED SYSTEM

CROSS-REFERENCE TO RELATED APPLICATIONS

The present application claims the benefit of, and priority to, U.S. Patent Provisional Application Ser. No. 61/149,985, filed on Feb. 4, 2009, and entitled "INFEED SYSTEM," which application is expressly incorporated herein by this reference, in its entirety.

BACKGROUND OF THE INVENTION

1. The Field of the Invention

Exemplary embodiments of the invention relate to apparatus, systems, devices, and methods for feeding and guiding materials through a converting machine. More particularly, example embodiments relate an infeed system usable for feeding fanfold packaging materials into a converting machine that produces packaging templates from the packaging materials.

2. The Related Technology

The automating of processes has long been a goal of industrialized society, and in virtually any industry in which a product is produced, some type of automated process is likely to be used. Oftentimes, the automated process may make use of modern technological advances that are combined into one or more automated machines that perform functions used to produce a product. The product produced by the automated machine may itself make use of raw materials. Such materials may themselves be loaded, provided, or otherwise introduced into the automated machine using an automated process, or such loading may be manual. Particularly where the loading is performed using an automated process, the raw materials may be positioned near the machine to facilitate loading.

The packaging industry is one example industry that has benefited greatly in recent years from the use of automating technology. For instance, boxes and other types of packaging may be formed out of paper based products (e.g., corrugated board), and an automated machine may be programmed to use one or more available tools to perform a number of different functions on the corrugated board. When loaded into the packaging machine, the corrugated board may be cut, scored, perforated, creased, folded, taped, or otherwise manipulated to form a box of virtually any shape and size, or formed into a template that may later be assembled into a box. One example of such a converting machine can be found in U.S. Pat. No. 7,100,811, which is expressly incorporated herein by this reference, and which may use various laterally spaced paths, so that multiple lines of packaging templates can be individually or simultaneously produced. In effect, the converting machine starts with a raw form of corrugated board (e.g., fanfold corrugated board in one or more separate feed paths) and converts the raw form into a template form that may then be assembled into a box or other type of package.

A converting machine that produces packaging templates may thus produce the packaging templates only after the corrugated board or other packaging material is introduced into the machine. Conventional fanfold configurations use stacks of multiple layers of packaging material. Each layer is approximately the same size and has pre-existing fanfold score lines at each end to separate the layers and allow the fanfold material to stack on top of itself. Thus, the raw fanfold board may be stacked in a loading position proximate the converting machine.

To introduce the fanfold into the converting machine, conventional converting machines utilize an infeed wheel to draw the fanfold into the converting machine. Conventional infeed wheels correspond to the dimensions of the fanfold score lines. For example, fanfold material may have score lines that are forty-eight inches apart. Therefore conventional converting machines can use an infeed wheel having corners that are forty-eight inches apart. Such infeed wheels that match the length of the fanfold material are specifically designed to avoid creasing the layers of fanfold material between the score lines as the additional creases have been seen as reducing the aesthetic appeal of the produced box template, and possibly the structural integrity.

By limiting the size of conventional infeed wheels to correspond directly to the size of the fanfold material layers, the infeed wheels may have a large size. With the large infeed wheels, the stack of raw materials must be placed further away from the converting machine, thus creating a large machine footprint. With the large footprint, space is occupied that may otherwise be valuable and usable for other operations, and higher overhead clearance may be needed. Moreover, as conventional infeed guides are designed to use the pre-existing score lines on the fanfold, conventional infeed guides are designed with a large radius to accommodate the turning of the fanfold from the infeed wheel into the converting machine in a manner that does not cause the fanfold to fold or bend between the predefined score lines on the edges of the stack of fanfold. The conventional large radius design of infeed guide produces a larger overall size of the converting machine which, in turn, also requires more space. Furthermore, because of the large size, conventional infeed wheels are more expensive to produce as they result in higher material, handling and tooling costs, thus increasing the cost of the converting machine as a whole.

Because the stack of raw fanfold and the size of conventional infeed wheels can be set apart at some distance, there is also an increased chance of inattentive operators creating safety hazards in using the converting machine. For example, the space between the stack of fanfold and the converting machine may allow space for an inattentive operator to walk between the stack of fanfold and the converting machine. As the infeed wheel rotates to feed the fanfold material, the infeed wheel may rotate and strike the careless operator.

Additionally, where the size of the infeed wheel is generally the same size as the distance between scores in fanfold material, changing to a different size of fanfold material may result in a need to modify or change out the infeed wheel to correspond to the different size of fanfold material. For instance, the infeed wheel may have expandable and/or retractable corners that allow some variation in size, although large changes in size of fanfold material may require swapping out for a different infeed wheel, and both modification or replacement of a wheel may cause significant down-time for the converting machine. Furthermore, the size of conventional infeed wheels generally force the converting machine to be shipped disassembled, thus requiring a costly and burdensome assembly process after the converting machine arrives at a customer's site.

Also, during a converting process, a converting machines may partially back-out the fanfold material to create the various templates. Because of the large size of the conventional infeed wheels, there is a significant resistance to backward movement that can frequently cause a conventional converting machine to jam, thereby increasing downtime and operating costs. Accordingly, there exists a need for alternative infeed systems that are more efficient and less costly, and which are less prone to downtime and delay.

BRIEF SUMMARY OF THE INVENTION

Exemplary embodiments of the invention relate to the devices, methods and apparatuses that feed fanfold material into a machine. Embodiments of the invention handle the fanfold material in a way that allows the feed components of the machine to be smaller relative to other converting machines. Moreover, embodiments of the invention provide devices and methods to prevent jams in the machine. Still more particularly, embodiments relate to an infeed wheel and infeed guides designed to efficiently feed fanfold material into a machine while reducing the size of the machine layout footprint and/or improving loading ease.

One example embodiment of the invention is a system for feeding raw material into a converting machine. The fanfold material may be configured with pre-existing fold lines separated by raw material. For example, the raw material between consecutive pre-existing fold lines may form a layer, panel, or blank. A feeding device may operate by use of an infeed wheel that engages the raw material. The infeed wheel is configured to facilitate creasing of the raw materials. For example, the infeed wheel may engage the raw materials at a pre-existing fold line, and then crease the panel of raw materials at a location between the pre-existing fold lines.

As the infeed wheel rotates, it optionally feeds the creased raw materials into an infeed guide. The infeed guide may include a set of rails that direct the path of the creased raw materials. Such infeed guide may allow the raw materials to bend at not only the original, pre-existing fold lines, but also at the creases. In some cases, a radius of curvature of the optional infeed guide is such that the raw materials must bend at the creases and not merely at the pre-existing fold lines.

In another example embodiment, a converting machine is used to convert fanfold material into packaging templates, and makes use of an infeed wheel that is configured to crease the fanfold material in various locations. The infeed wheel includes, in one example, three radial members that are angularly spaced. The infeed wheel may connect to a shaft or other axle that allows the infeed wheel to rotate forward as the fanfold material is pulled into the converting machine. The infeed wheel may operate in a feed direction, and optionally in a direction transverse to the feed direction. Such transverse direction may be utilized to back out the fanfold materials and/or in the performance of certain converting functions.

A converting machine according to some embodiments includes an optional infeed guide that is configured to change the orientation of the fanfold material from a substantially vertical orientation to a substantially horizontal orientation by directing the fanfold material around a radius portion of the infeed guide. The radius portion of the infeed guides may be configured to utilize creases formed in the fanfold material between panel edges, thus allowing the radius portion of the infeed guides to have a smaller radius as compared to conventional converting machines. The infeed guide may direct the creased fanfold material into a converting mechanism that performs various actions that crease, bend, fold, perforate, cut, score, or any combination thereof, to create packaging templates.

Another example embodiment of the invention includes a method for feeding fanfold material into a machine. The method comprises, in one embodiment, engaging the fanfold material with an infeed wheel and creasing the fanfold material with the infeed wheel as the infeed wheel rotates. The creases may be pre-existing, or may be initially formed by the infeed wheel. In some cases, the pre-existing creases are generally perpendicular to a feed direction and are located at intermediate locations in a stack of fanfold material, rather than along a boundary edge that is also perpendicular to the feed direction. The method may further include directing the creased fanfold material into a converting machine using an infeed guide. In order to direct the fanfold material, the infeed guides may re-orient the fanfold material along a path that moves in different directions. For example, the fanfold material may be directed in a vertical direction and then be reoriented in a horizontal direction. Vertical-to-horizontal reorientation may be performed using a curved guide. The curve on the guide optionally is sized such that the fanfold material creases at the intermediate creases and not merely at the boundary edges.

According to another embodiment, a stack of fanfold material is described that is folded not only along boundary edges, but at intermediate locations between the boundary edges. For example, multiple layers of fanfold material may be combined into a stack. The size of the layers may be defined by boundary score lines that run along opposing outer edges of the stack. Each layer may be about the same size. Each layer may also include one or more score or crease lines that are not at the boundary score lines, but are pre-formed between the boundary score lines, and parallel to the boundary score lines. The manner in which the fanfold material is stacked may allow the layers to be pulled off in a fanfold fashion, from alternating boundary edges. Moreover, each layer need not be identical, and some layers may have different locations or numbers of intermediate creases or scores. Other stacks may have identical layers as to the approximate size, number, and positioning of intermediate creases.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the Summary above and other advantages and features of the present invention, a more particular description of the invention will be rendered by reference to specific embodiments that are illustrated in the appended drawings. It is appreciated that these drawings depict only typical embodiments of the invention and, therefore, are not to be considered limiting of its scope. Moreover, the appended drawings, while generally illustrating one suitable scale for the present invention, are not necessarily to scale for all embodiments. Accordingly, the invention will be described and explained with additional specificity and detail through the use of the accompanying drawings in which.

DETAILED DESCRIPTION OF SOME EXAMPLE EMBODIMENTS

Figure 1A:
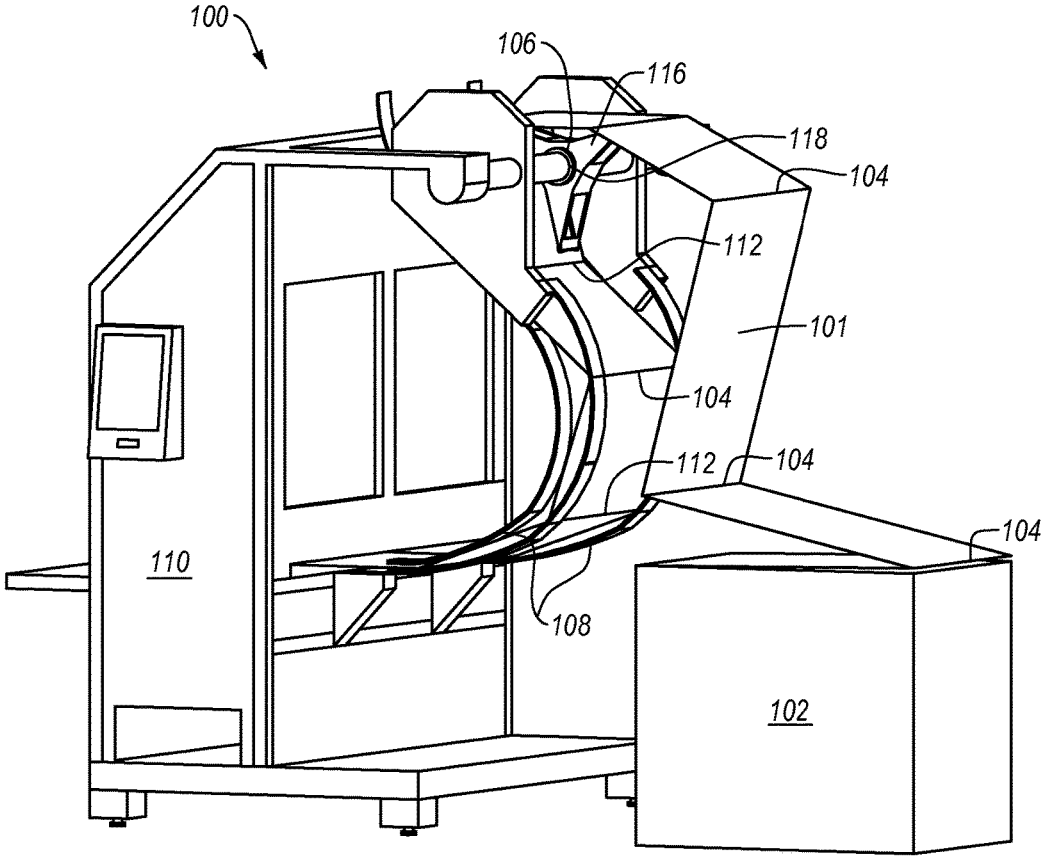
FIG. 1A illustrates a perspective view of an exemplary converting machine having an infeed system feeding packaging materials to a converting mechanism according to one embodiment of the present invention.

The embodiments described herein extend to methods, devices, systems, assemblies, and apparatuses for feeding fanfold material into a machine. More particularly, exemplary embodiments relate to methods, apparatus and systems for feeding raw packaging materials into a converting machine for conversion into a box template.

In describing and claiming the present invention, the term "converting machine" is utilized herein to generically describe a variety of different machines that may take raw materials and convert the raw materials into a different form or structure. In particular, "converting machine" as used herein includes packaging machines that receive packaging materials (e.g., corrugated board) and cut, perforate, crease, score, fold, or otherwise modify the packaging materials to produce a box template. The term "converting machine" may, however, refer to other types of machines and industries, and is not necessarily limited to machines used to make box templates, nor to machines usable in the packaging industry.

Further, in describing and claiming the present invention, the term "packaging materials" is utilized herein to generically describe a variety of different types of materials that may be converted using a converting machine. In particular, "packaging materials" may be used to effectively refer to any material that can be converted from a raw form into a usable product, or into a template for a usable product. For instance, paper-based materials such as cardboard, corrugated board, paper board, and the like may be considered "packaging materials" although the term is not necessarily so limited. Accordingly, while examples herein describe the use of corrugated board and fanfold corrugated board, such are merely exemplary and not necessarily limiting of the present application.

Additionally, the term "package" may be used in describing and claiming the present invention, and is used to generically describe different types of packages and packaging components that can be used to package, transport, and/or ship items. For example, a box may be one type of package, although "package" should not be narrowly construed to include only boxes, or to only include packages of a particular shape, size, or configuration. Thus, a "package" may be of any shape or size. The term "template" may also be used herein interchangeably with "package" in cases where the template can be assembled to produce the "package."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Further, numerical data may also be expressed or presented herein. It is to be understood that such numerical data is used merely to illustrate example operative embodiments. Moreover, numerical data provided in range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. Furthermore, such numerical values and ranges are intended to be non-limiting examples of example embodiments, and should not be construed as required for all embodiments unless explicitly recited as such in the claims.

Reference will now be made to the exemplary embodiments illustrated in the figures, wherein like structures will be provided with similar reference designations. Specific language will be used herein to describe the exemplary embodiments, nevertheless it will be understood that no limitation of the scope of the invention is thereby intended. It is to be understood that the drawings are diagrammatic and schematic representations of various embodiments of the invention, and are not to be construed as limiting the present invention, unless such shape, form, scale, function or other feature is expressly described herein as essential. Alterations and further modifications of the inventive features illustrated herein, and additional applications of the principles of the inventions as illustrated herein, which would occur to one skilled in the relevant art and having possession of this disclosure, are to be considered within the scope of the invention.

Additionally, no particular elements should be considered essential for all embodiments, nor should any elements be required to be assembled or manufactured in any particular order or manner, unless expressly recited in the claims or identified as being essential. Accordingly, no inference should be drawn from the drawings as to the necessity of any element. In the following description, numerous specific details are set forth in order to provide a thorough understanding of the present invention. It will be obvious, however, to someone of ordinary skill in the art that the present invention may be practiced without these specific details. In other cases, general manufacturing techniques and packaging products, as well as various well-known aspects of the operation of packaging machines, including at least the mechanics of producing the box template once raw materials are fed into the packaging machine, are not described herein in detail in order to avoid unnecessarily obscuring the novel aspects of the present invention.

Figure 1B:
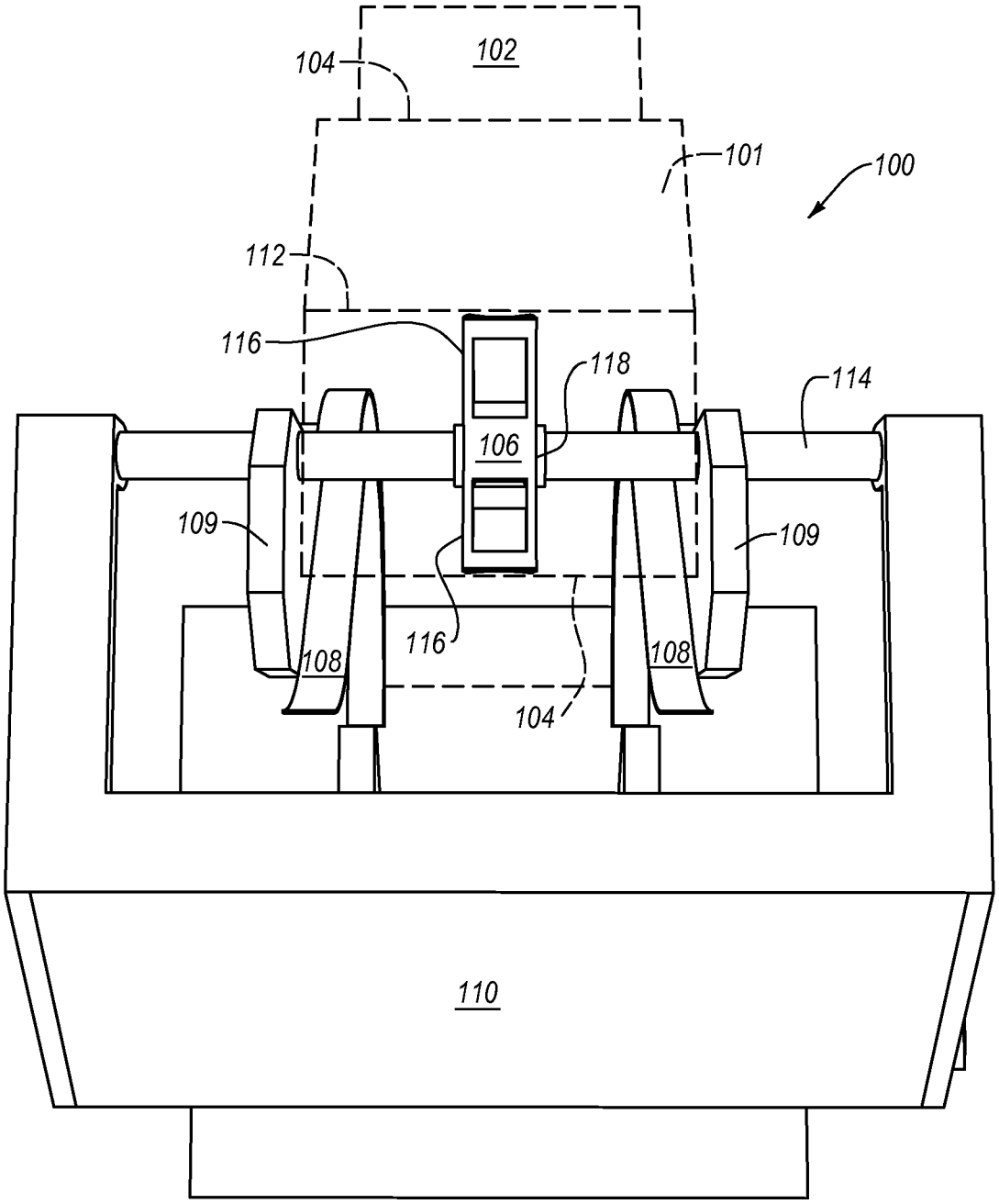
FIG. 1B illustrates an overhead view of the converting machine and infeed system of FIG. 1A, with the packaging materials in phantom lines to illustrate various interior components.
Figure 1C:
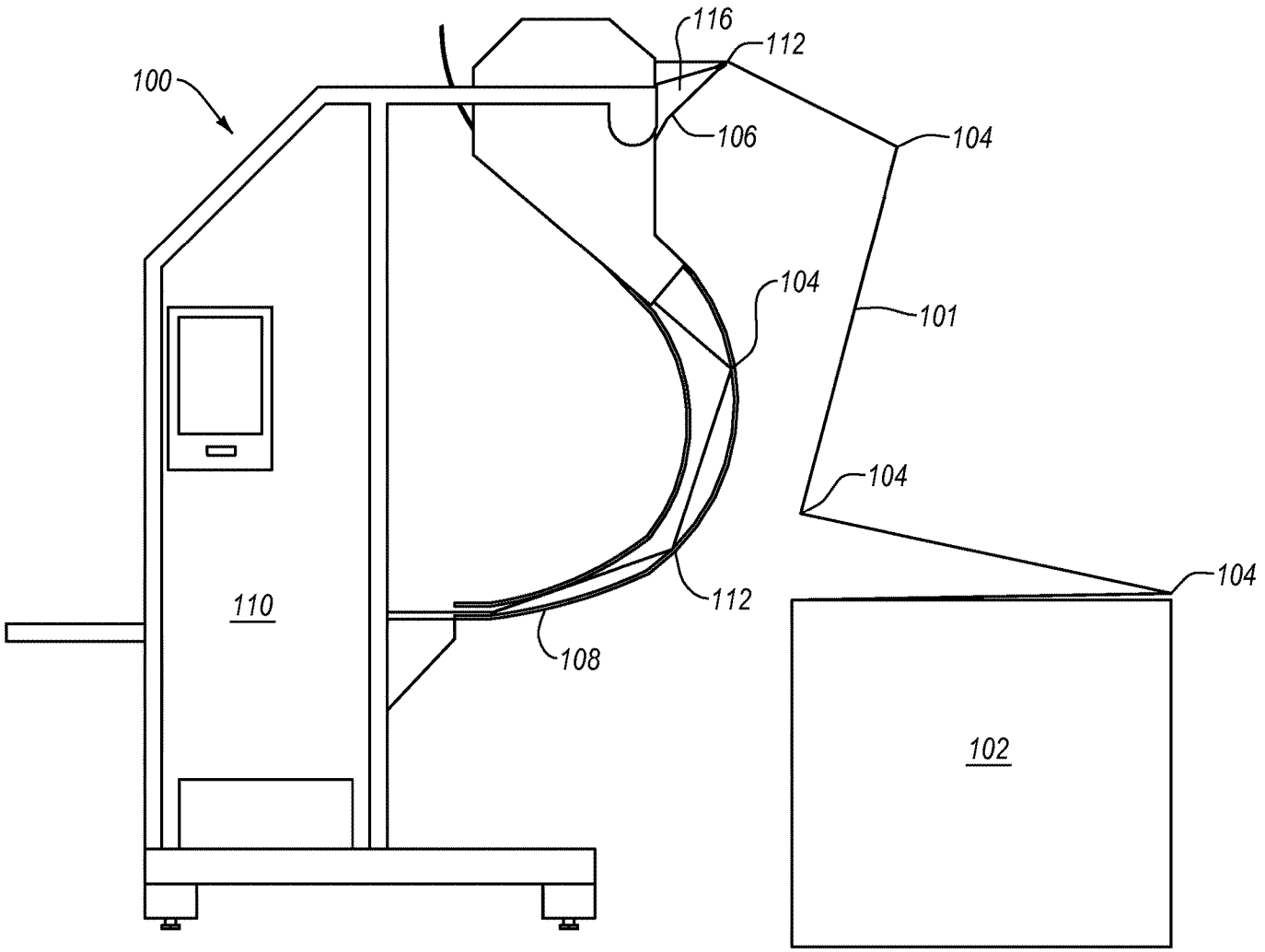
FIG. 1C illustrates a side view of the converting machine and infeed system of FIG. 1A.

FIGS. 1A-1C are presented herein to provide a brief general description of an exemplary converting machine 100 in which embodiments and aspects of the invention may be implemented. FIGS. 1A and 1B, for example, provides perspective view and overhead views of converting machine 100, respectively, and illustrate the manner in which converting machine 100 may be used to convert raw materials 101 provided in a fanfold stack 10. In this example embodiment, fanfold material stack 102—which is shown in phantom lines in FIG. 1B—is placed in close proximity to converting machine 100, and provides raw packaging materials 101 thereto. Fanfold stack 102 may be formed of a plurality of different layers of packaging materials 101. For instance, according to one example embodiment, a score line 104 may be formed at the opposing edges of each layer of packaging materials 101 in fanfold stack 102, and can demark the transition from one layer to the next. Each layer may be generally positioned in stack 102 such that it is vertically lower than a prior layer, and vertically higher relative to a subsequent layer.

Score lines 104 may be formed in raw packaging materials 101 in any suitable manner. For example, as packaging materials 101 are formed into a desired width, thickness, and the like, the manufacturing process may also include using a blade to crease across the width of packaging materials 101. The blade may crease at predetermined intervals, and such a crease optionally includes a partial cut into the raw packaging materials 101, thereby forming score lines 104. As packaging materials 101 are then folded, each area between score lines 104 may form a separate layer and be folded in a fanfold manner so as to allow each layer to be separately identifiable relative to adjacent layers, but also continuously connected. Thus, fanfold stack 102 may be an endless stack of materials 101. Further, score lines 104 are merely exemplary and, in other embodiments, different mechanisms may be used to identify separate layers. For instance, in some embodiments, layers may be separated by fold lines, creases, partial cuts, perforations, and the like at the edges of fanfold stack 102, such that scoring raw materials 101 is not necessary. In still other embodiments, a single layer may have one or more intermediate score lines.

As noted herein, a particular aspect of score lines 104 is that they allow raw material 101 to fold over itself to form the multiple layers of fanfold stack 102. Thus, when viewing stack 102 from a side or overhead view, score lines 104 can be at the edges of fanfold material stack 102. As packaging material 101 from fanfold stack 102 is fed into converting machine 100, an infeed wheel 106 may then engage packaging material 101 and direct it off fanfold stack 102. Converting machine 100 may also include one or more infeed guides 108. Infeed guides 108 may, for example, be a set of rails between which packaging material may be positioned, and which collectively guide packaging material 101 after engagement with infeed wheel 106, and direct it into a converting mechanism 110 that can convert packaging material 101 into a package and/or package template.

The drive force of infeed wheel 106 can be operated in any suitable manner. For example, according to one embodiment, infeed wheel 106 may be driven on a shaft 114 that is rotated by a motor or other drive mechanism. As shaft 114 rotates, infeed wheel 106 may have a corresponding rotation and can operate as the driving force that lifts layers of packaging materials 101 from fanfold stack 102, and feeds them into converting mechanism 110. Infeed guides 108 optionally assist in directing packaging materials 101 into converting mechanism 110, and can define the general path raw materials 101 take as they move from infeed wheel 106 to converting mechanism 110. In other embodiments, the drive force may come from packaging materials 101. For example, converting mechanism 110 may include one or more rollers which pull packaging materials 101 into converting mechanism 110. As such force is applied to packaging materials 101, the force can be translated to infeed wheel 106 which rotates from the force applied by packaging materials 101. Infeed wheel 106 optionally rotates on shaft 114, or may rotate coincident with shaft 114.

Regardless of whether the drive mechanism is applied directly to infeed wheel 106, to packaging materials 101 in a manner that causes infeed wheel 106 to rotate, or a combination thereof, infeed wheel 106 may, during operation, engage fanfold packaging material 101 and lift packaging material 101 from fanfold stack 102. For example, from the side view in FIG. 1C, infeed wheel 106 can rotate in a counter-clockwise direction to lift packaging materials 101 off fanfold stack 102, and direct packaging materials 101 forward, as directed by infeed guides 108, and into converting mechanism 110. As best shown in FIG. 1A, an example infeed wheel 106 may be a three-pronged wheel that has three radial members 116 extending from a central hub 118. As infeed wheel 106 rotates, the radially distal end of one or more of radial members 116 may be configured to engage packaging material 101. For instance, one radial member 116 may engage packaging material 101 at a position proximate a score line 104. Other radial members 116 may also engage packaging material 101, but do not necessarily engage packaging material 101 at a location proximate a score line 104. For example, the chord length between the radially distal ends of radial members 116 may be approximately half, one-third, one-fourth, or another equally dividable factor of the length of each layer of packaging materials 101 in stack 102. As a result, radial members 116 may engage materials 101 at positions approximately half-way, one-third-way, one-fourth-way, etc., between score lines 104. Consequently, radial members 116 optionally create new creases or folds 112 in packaging materials. Thus, in some embodiments, infeed wheel 106 acts as a means for creasing packaging materials 101.

As shown in FIG. 1C, after infeed wheel 106 has engaged, and optionally created creases 112 at a location between consecutive score lines 104, packaging materials 101 can be passed over infeed guides 108. As noted previously, infeed guides 108 can primarily act to direct the path of packaging materials 101 from infeed wheel 106 to converting mechanism 110. In the illustrated embodiment, for instance, infeed guides 108 are configured to change the orientation of packaging materials 101 from a substantially vertical position to a substantially horizontal position. In cases where the converting mechanism 110 desires that the fanfold material 101 be backed-out (e.g., to perform a converting function, to clear a jam, or for other reasons), the mechanism driving infeed wheel 106 may change the rotation of infeed wheel 106. For instance, in FIG. 1B, infeed wheel 106 may rotate in a clockwise direction, thus pulling packaging materials 101 in a manner that causes the packaging materials to move horizontally and/or vertically over guides 108 and away from converting mechanism 110, and towards fanfold stack 102.

As best illustrated in FIG. 1B, it should also be appreciated that converting machine 100 is adjustable, and can accommodate multiple different sizes of fanfold material 101. For example, in the illustrated embodiment, guides 108 and/or infeed wheel 106 may be selectively secured to shaft 114, or may slide axially thereon. More particularly, in this embodiment guides 108 connect to supports 109 which are in turn coupled to shaft 114. Supports 109 may slide axially along shaft 114. Thus, if raw materials 101 are removed and replaced with other materials that have a larger or smaller width, supports 109 may slide along shaft 114 to axial positions corresponding to the new width of the raw materials. Guides 108 may thus also be moved into a suitable position. Furthermore, infeed wheel 106 may have, for example, a locking mechanism that locks it to shaft 114 such that it rotates with shaft 114. That mechanism may be loosened to allow infeed wheel 106 to move. For instance, multiple infeed wheels 106 may be positioned on shaft 114 to collectively or individually lift and feed raw materials 101, or for different respective stacks 102 of raw materials 101.

Figure 2:
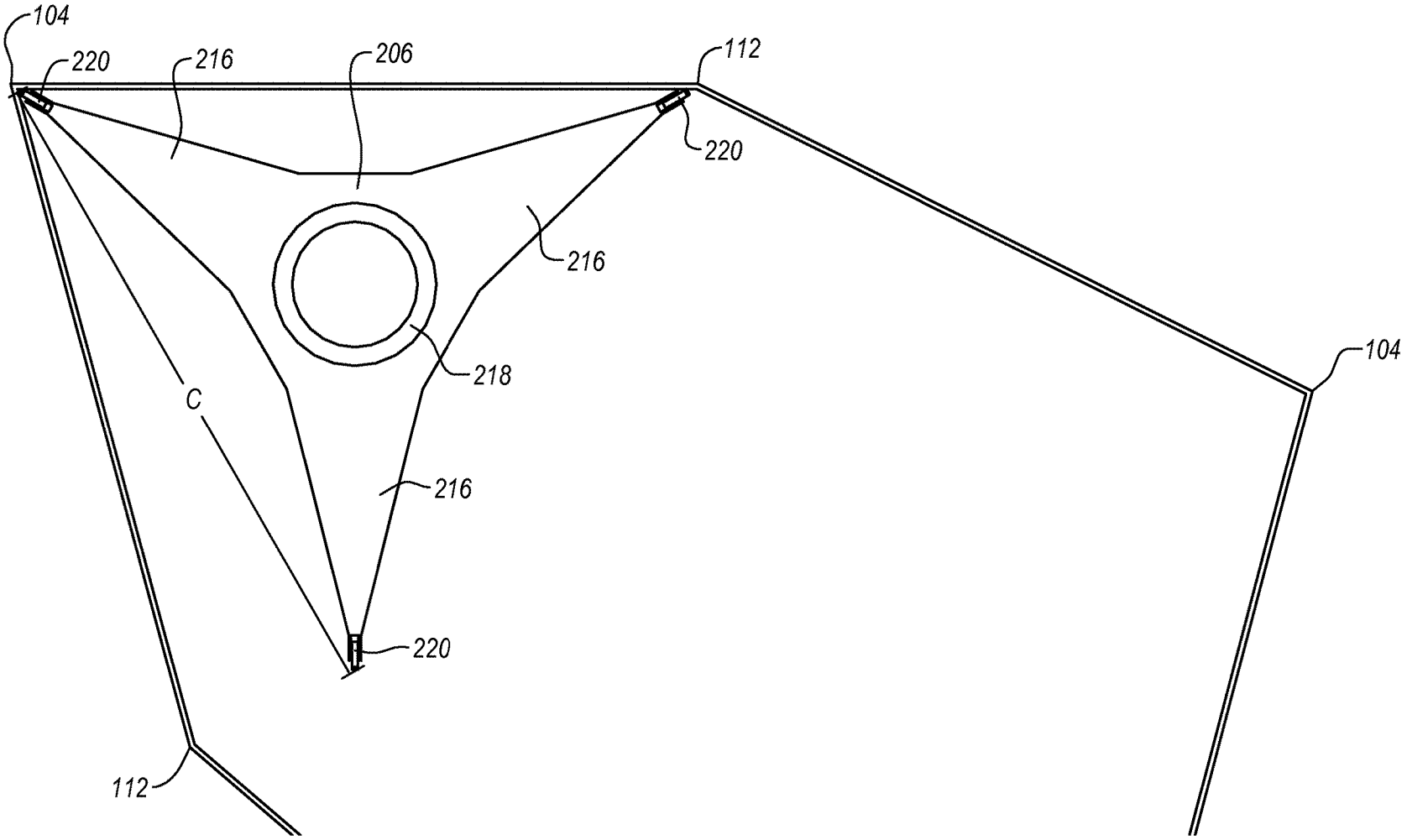
FIG. 2 illustrates an enlarged view of an infeed wheel and packaging materials being fed thereby.

Turning now to FIG. 2, a more particular illustration of an exemplary infeed wheel 206 is illustrated. In particular, FIG. 2 illustrates an enlarged view of infeed wheel 206 capable of feeding raw materials 101 to a converting machine, and which optionally creases raw materials 101 at one or more locations between consecutive score lines 104.

More particularly, the illustrated infeed wheel 206 is a three-prong wheel configured to rotate about an axis. In this embodiment, three radial members 216 extend radially outward from a central hub 218. According to the illustrated embodiment, radial members 216 are approximately equally angularly spaced around central hub 218, and are centered at approximately one hundred twenty degree angular intervals. Naturally, however, other angular intervals may be chosen. For instance, in some embodiments, three radial members may be spaced at unequal intervals. In still other embodiments, different numbers of radial members (e.g., two, four, five, etc.) may be formed on the infeed wheel, thereby also resulting in different angular spacing between the radial members. Additionally, while a single infeed wheel 206 is illustrated, multiple infeed wheels may be used to collectively move raw materials 101, or may individually operate to drive different stacks of packaging materials.

According to one aspect of the present invention, infeed wheel 206 may be used with virtually any size of raw materials. For example, in this embodiment, a chord length c is defined between distal ends of successive radial members 216. Optionally, chord length c is configured to have a relationship with the size of the layers of raw materials 101, although this need not necessarily be so. For example, layers of raw materials 101 in FIG. 2 have a length defined between two successive score lines 104. Chord length c, however, may be substantially less than the distance between score lines 104. In the illustrated embodiment, for instance, chord length c is approximately half the distance between score lines 104, although different relationships may also be used, as discussed in more detail herein. For instance, the chord length c may be one-third, one-fourth, or any other length that can be evenly divided into the length defined between two successive score lines 104.

As infeed wheel 206 in FIG. 2 has chord length c that does not span the entire length between score lines 104, infeed wheel 206 is optionally configured to crease raw materials 101 at a location between score lines 104. For instance, FIG. 2 illustrates one score line 104 engaged with one of radial members 216. A successive radial member, however, is not engaged at a score line 104. Instead, as raw materials 101 are driven around infeed wheel 206, the successive radial member 216 instead engages at a crease line 112. Crease line 112 may also be formed by radial member 216, although in other embodiments crease line 112 is formed prior to engagement with radial member 216. For instance, a stack of raw materials 101 have creases pre-formed at locations between score lines or other stack edges.

As will be appreciated in view of the disclosure herein, an infeed wheel 206 that is not the same size as the panels of the fanfold material 101 could be used for multiple different sizes of fanfold material 101. For instance, an infeed wheel that has a triangular configuration similar to that of infeed wheel 206 of FIG. 2 may have a chord distance of approximately sixteen inches, although larger and smaller chord distances may be used based on the particular application. In the case of a sixteen inch chord distance, if fanfold material 101 has a panel length of thirty-two inches, such an infeed wheel may form one crease approximately half-way between each score line. In other cases, however, a sixteen inch infeed wheel may be used with fanfold material 101 having a panel length of forty-eight inches. As the infeed wheel feeds fanfold material 101 into a converting machine as described herein, a first radial member 216 can engage a preexisting score line 104. The infeed wheel could then make a full revolution and the same radial member 216 could then engage the next preexisting score line 104. During such revolution, the second and third radial members 216 may engage at locations not corresponding to score lines, and can create two creases 112 between consecutive score lines 104.

Notably, however, the same infeed wheel could be used with still other sizes and lengths of fanfold material 101. In other embodiments, for instance, the length of a panel of raw materials 101 may be greater than three times chord length c (e.g., four to eight times). Additionally, while chord length c may have a direct relationship with the length of a single panel layers of raw materials 101, this need not be so. For example, in some embodiments, chord length c may be sized to correspond to the length of two panels of raw materials 101. For instance, chord length c may be approximately twenty inches, while raw materials may have a length of thirty inches. Thus, if the infeed wheel has three radial members, a first may engage at a first score line, and then complete a full revolution before the same radial member engages a third score line. The second and third radial members may each create creases approximately ten inches from a second score line between the first and second score lines.

In still other embodiments, there may be no direct relationship between chord length c the length of any number of panels of raw materials 101. Indeed, it is not necessary that radial members 216 engage score lines 104, and may instead engage at any location on raw materials 101. For instance, FIG. 2 illustrates an example in which radial members have an engaging member 220 attached at the radially distal end thereof. Engaging member 220 may be configured to engage a score line and/or create a crease. In other embodiments, however, engaging member 220 may configured to engage any location of raw materials 101. Thus, regardless of whether there is a relationship between chord length c and the distance between score lines 104, engaging member 220 may act as a gripping mechanism. For instance, engaging member 220 may be formed of an anti-slip material, or have an anti-slip coating thereon, such that it can engage raw materials 101 with little to no slip therebetween. In one example, engaging members 220 may be a polymeric material such as rubber, may have a gritty coating, may have a suction mechanism, or otherwise have a non-slip surface or mechanism attached thereto.

Although not necessary for all embodiments, engaging members 220 may also be adjustable. For instance, engaging members 220 may be connected to radial members 216 using one or more screws, clamps, or other fasteners. If such fasteners are loosened, engaging members 220 may be moved radially inward or outward relative to central hub 218, thereby allowing chord length c to be varied. In one embodiment, each of engaging members 220 can be moved so as to vary chord length c by up to six inches, although it will be appreciated by one skilled in the art that this is exemplary only and in other cases, infeed wheel 206 may be adjustable and can have its chord length c adjusted by even more than six inches.

Accordingly, the shape, dimensions, and construction of infeed wheel 206 may be varied. Additionally, the material used in the manufacture of infeed wheel 206 may likewise be varied as suitable or desired for a particular machine, fanfold material, location, application, and the like. For example, infeed wheel 206 may primarily be made from a metal material (e.g., aluminum, steel, titanium, stainless steel). Additionally, or alternatively, other portions of infeed wheel 206 may be formed of other materials, including plastics, alloys, other metals, wood or other organic materials, composites, and/or combinations thereof.

In addition to variations in the material of infeed wheel 206, engagement members 220 may be made from various materials. For example, engagement members 220 may be inserts that are formed separate from infeed wheel 206, and can thus be made from the same or a different material as compared to infeed wheel 206. Example engagement member 220 materials include, but are not limited to, metals, alloys, plastics, composites, wood, organic materials and/or and combination thereof.

Figure 3A:
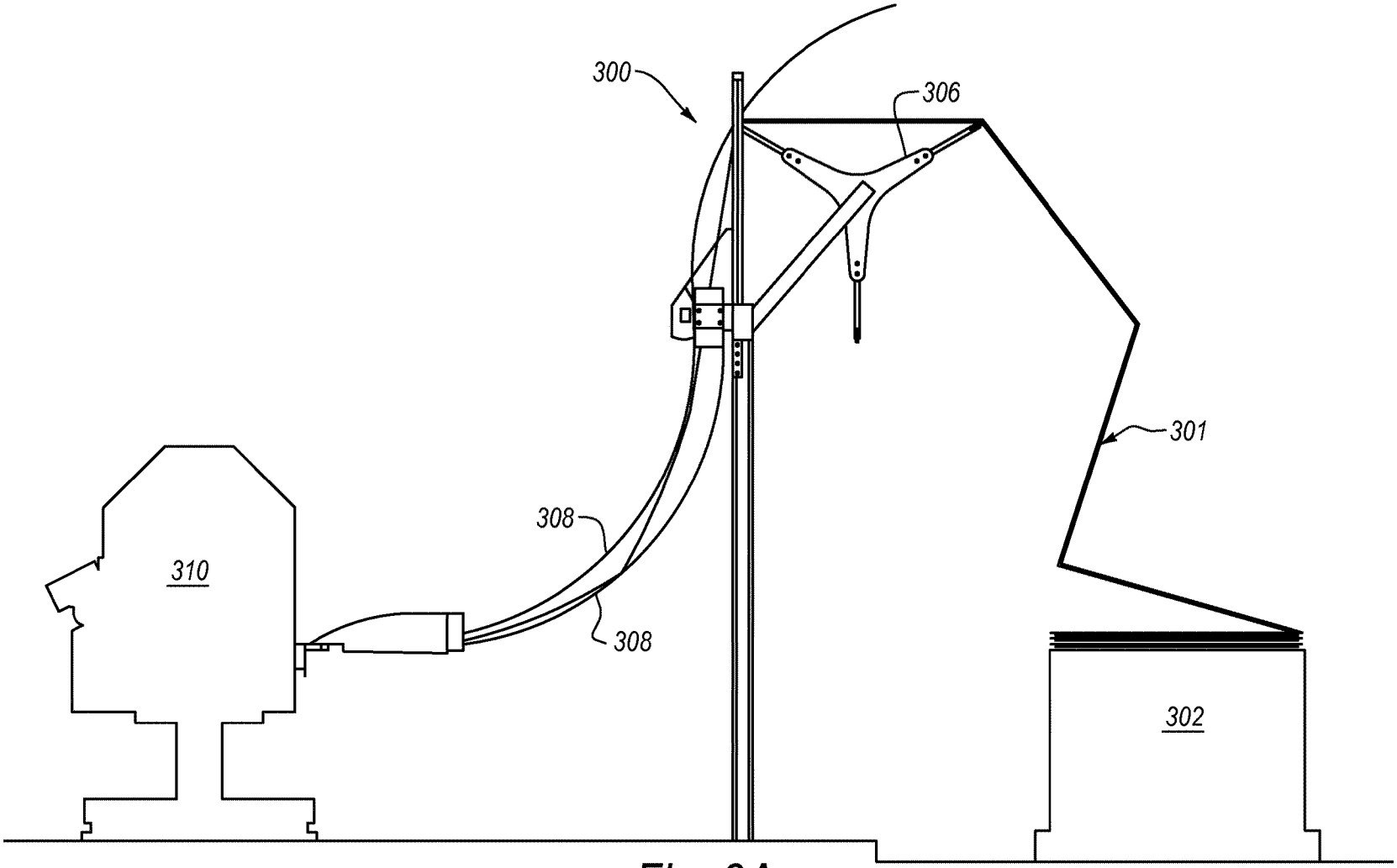
Fig. 3A (Prior Art)
FIG. 3A illustrates a prior art infeed system having an infeed wheel and infeed guides sized to prevent creasing of packaging materials.
Figure 3B:
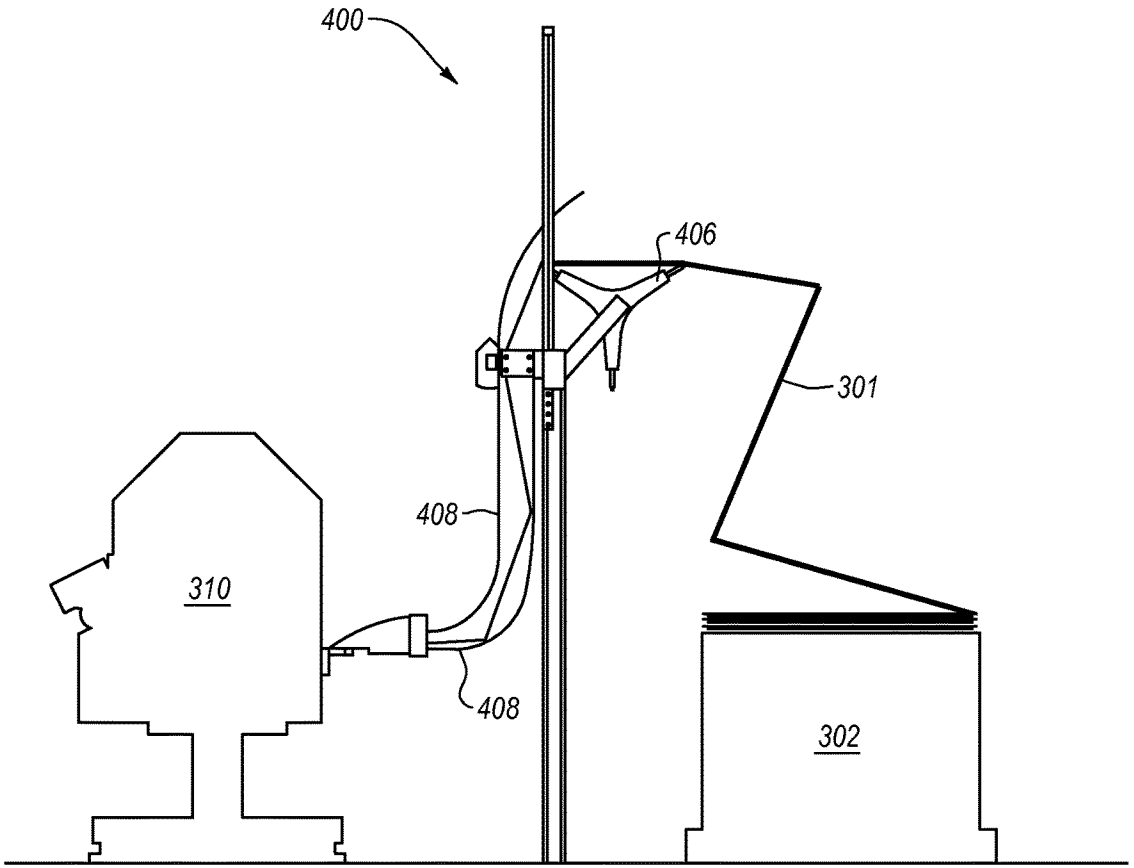
FIG. 3B illustrates an infeed system according to one example embodiment of the present invention, in which additional creases are created and used by an infeed wheel and/or infeed guides.

The effects of using an infeed system as described herein can be more fully appreciated upon a review of FIGS. 3A and 3B. FIG. 3A, for instance, illustrates a conventional converting machine and infeed system, and is exemplary of the system described in U.S. Pat. No. 7,100,811. As shown in FIG. 3A, infeed system 300 includes an infeed wheel 306 configured to engage raw packaging materials 301 and direct them off a fanfold stack 302 and into a converting machine 310. As part of the system, infeed wheel 306 has a size specifically designed to prevent additional folding in any layer of raw materials 101.

As a result of the specific desire to avoid additional folds or creases in raw materials 101, converting machine 101 has as a height that is greater than absolutely necessary. Thus, to reduce the height requirement, fanfold stack 302 may be even positioned at a depression. Further, as shown in FIG. 3A, the desire to avoid creasing fanfold packaging materials 301 leads to the use of elongated guides 308 that direct packaging materials 301 from infeed wheel 306 into converting machine 310. More particularly, generally S-shaped guides 308 are elongated to have long curve radii so as to prevent creasing in raw materials 101.

In contrast, infeed system 400 may use the same converting machine 310, but have a smaller device footprint relative to a converting machine using infeed system 300, or to another converting machine lacking features described herein. For example, unlike infeed system 300 that has infeed wheel 306 specifically configured to be the size of the fanfold material 301 so as not to cause additional creasing in fanfold material 301, infeed wheel 406 is configured such that fanfold material 301 may be creased at locations between pre-existing score lines. Therefore, infeed wheel 406 can be much smaller relative to infeed wheel 306 or other infeed wheels that are designed to only bend fanfold material 301 at the pre-existing score lines.

The smaller infeed wheel 406 can also lead to lower overall converting machine height and length dimensions relative to conventional converting machines, thus allowing the converting machine and infeed system to be located in a building with less vertical clearance and/or a smaller available footprint. For example, infeed system 400 may require a vertical clearance of about one hundred inches, whereas infeed system 300 may require a vertical clearance of about one hundred fifty inches or more.

Further space savings may be realized by changes that may be made to the infeed guides. For example, due to the smaller infeed wheel 406, and the additional creases in the fanfold raw packaging materials 301, infeed guides 406 may be designed with a much smaller infeed guide radius relative to conventional infeed guides. More particularly, the additional creases in same length fanfold material 301 allow fanfold material 301 to have its orientation changed from a substantially vertical position to a substantially horizontal position in a much shorter horizontal distance relative to infeed guides 308 of FIG. 3A. This is allowed as the additional creases enable fanfold material 301 to bend around a smaller radius. Furthermore, smaller infeed wheel 406 and/or smaller infeed guides 408 may also enable infeed system 400 to be shipped already assembled due to the overall smaller size of the assembly.

To facilitate the directing of packaging materials 301 into converting mechanism 310, guides 408 are illustrated as having a generally S-shaped fanfold feed path. The S-shaped fanfold feed path of FIG. 3B is substantially condensed in both the vertical and horizontal directions relative to the feed path defined by guides 308 in FIG. 3A. For example, the feed path in FIG. 3B may be approximately eighty inches high by fifty inches wide, whereas the feed path in FIG. 3A may instead be approximately one hundred twenty inches high and seventy-five inches wide.

Accordingly, aspects of the embodiment in FIG. 3B relate to the condensed footprint of infeed system 400. Additional aspects include increased safety of infeed system 400. For example, in the illustrated embodiment, infeed wheel 406 is generally positioned near a top of the S-shaped fanfold feed path that includes infeed guides 408. In one aspect, the S-shaped fanfold feed path extends laterally from infeed wheel 406 towards converting machine 310. In other embodiments, however, the S-shaped fanfold feed path may extend at least partially towards fanfold stack 302. For instance, in FIG. 1C, guides 108 extend laterally towards fanfold stack 102 and thus cover a bottom portion of infeed wheel 106. This can further facilitate folding of the raw materials 101 over themselves as they are being directed to the converting mechanism. In one aspect, the folding of fanfold in this manner not only further reduces the footprint, but also acts as a barrier to reduce the risk of an inattentive operator being able to touch infeed wheel 106.

Thus, the actual fanfold feed path may vary from one embodiment to the next. Thus, while an S-shaped fanfold feed path is illustrated and described, other various shaped fanfold feed paths may be implemented with various embodiments of the invention. For example, a pallet or stack of fanfold material 301 may be placed on the same level as infeed wheel 406, thus producing more of an L or J-shaped fanfold feed path. In other embodiments, and as described herein, the fanfold feed path may double-back so as to also cover at least a portion of the bottom side of the infeed wheel as an additional safety precaution.

The relative decrease in size of infeed wheel 406 and/or infeed guides 408 can also allow fanfold material stack 302 to be placed closer to converting mechanism 310 relative to the placement of fanfold material stack 301 and converting mechanism 310 in connection with infeed system 300 of FIG. 3A. For example, as shown in FIGS. 1A-1C, the placement of a fanfold material stack may be substantially directly proximate to the converting mechanism, thereby reducing the device layout footprint when the converting machine is in operation, and also improving loading ease while further substantially reducing the likelihood that an inattentive operator or other person will walk between the fanfold material stack and the converting machine.

As noted previously, an optional mechanism may be included that allows or causes infeed wheel 406 to rotate in a backward direction. Infeed system 400 may further decrease the risk of fanfold packaging materials 301 jamming within infeed system 400 as infeed wheel 406 rotates in a backward direction. For example, a spring mechanism may be charged by the forward movement of infeed wheel 406. As a backward feed is needed, the charge can be fully or partially released to thereby back fanfold material 301 out of converting mechanism 310. In another example embodiment, the backward motion may be caused or facilitated by a gravity mechanism that uses gravity to rotate infeed wheel 406 in the backwards direction when fanfold material 301 is backed out of converting mechanism 301. In other example embodiments, the infeed wheel may be coupled to a motor or transmission system that can operate in forward and/or reverse directions.

Regardless of the particular manner of allowing backing-out of fanfold material 301, and whether such motion is generally fluid or occurs in an abrupt fashion, the risk of jamming may be reduced due to the additional creases produced by infeed wheel 406. The additional creases produced by infeed wheel 406 allow the fanfold material to move more freely within infeed system 400, thus reducing the risk of a jam relative to other converting machines that do not create, and specifically avoid, additional creases.

The material of infeed guides 408 may also vary and, according to at least one embodiment, can be made of a friction reducing material, or otherwise have a fiction reducing material applied thereto. For example, infeed guides 408 may be formed from a metal material that may be coated in a low friction coating. Such a low friction coating allows fanfold material 301 to be fed through infeed guides 408 with less resistance and, in addition, allows fanfold material 301 to be more easily backed out through infeed guides 408 during converting mechanism operations. The low friction coating provides protection against risk of a jam during the converting machine operation.

In other example embodiments, the infeed guide material may simply be an uncoated metal, alloy, plastic, composite or any other material that is able to be formed into a desired shape. Moreover, the material of guides 408, or a coating or other material applied thereto, if any, may vary from one embodiment to the next. For example, in one embodiment guides 408 may be a polished metal material. In another embodiment, guides 408 may have a powder coat or other type of paint thereon. In another example, a coating may include one or more of various substances designed to reduce the friction and protect infeed guide 408 (e.g., physical vapor deposition (PVD) coating, Teflon, Starcote, Xylan, carbon-based dry/solid lubricant, near-frictionless carbon (NFC), molybdenum disulphide-based coating, buckminsterfullerene, and the like).

Figure 4:
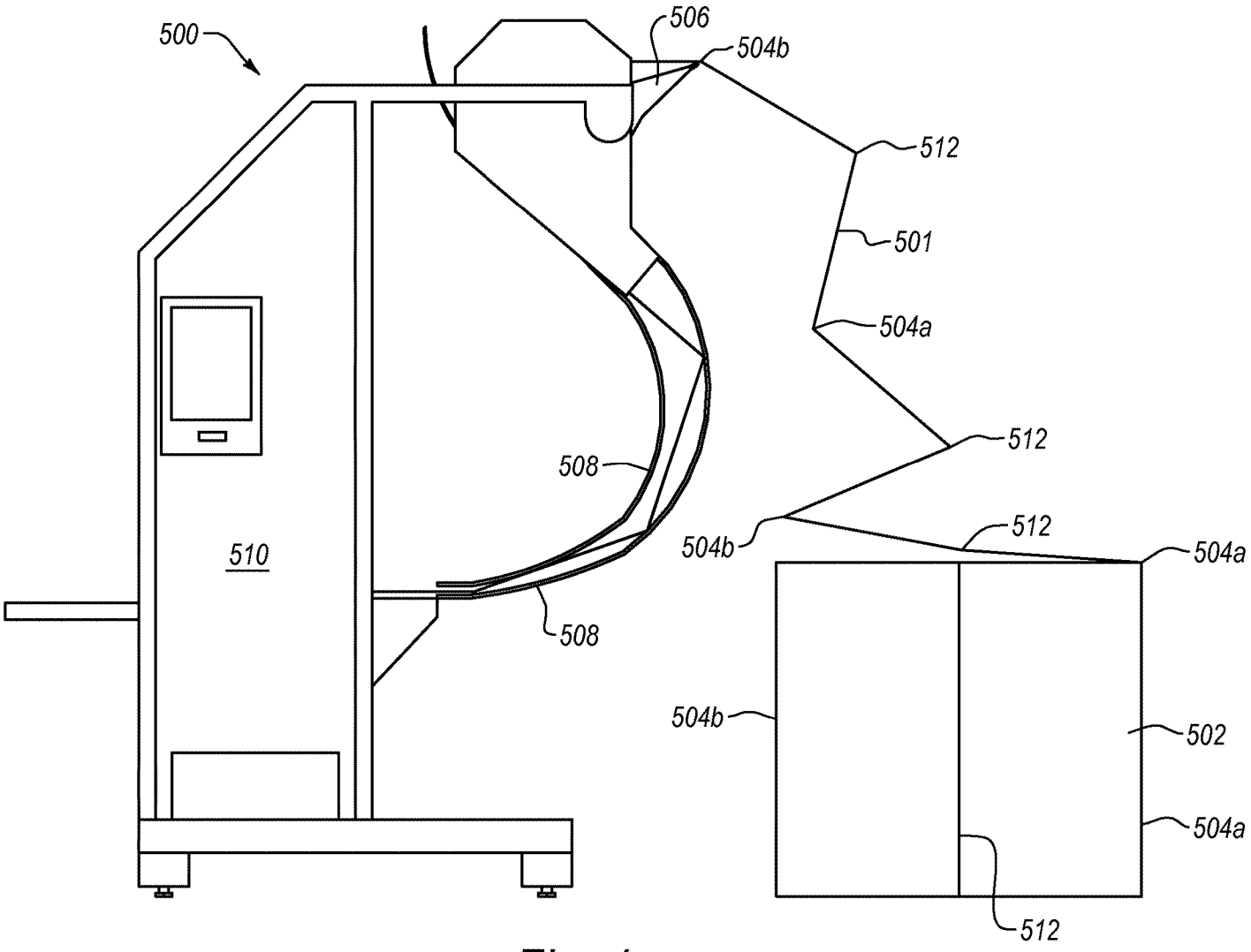
FIG. 4 illustrates a side view of an exemplary converting machine drawing raw materials from a fanfold stack of raw materials that have pre-formed intermediate creases.

Turning now to FIG. 4, still another example embodiment of a converting machine 500 is illustrated. As will be appreciated by one skilled in the art in view of the disclosure herein, converting machine 500 may be generally similar to the converting machines described herein. Accordingly, similar components will not be described in detail so as to avoid unnecessary obscuring components of converting machine 500. With respect to converting machine 100 in FIG. 1C, it will be noted that converting machine 500 also includes a fanfold stack 502 of packaging materials 502. Unlike the fanfold stack in FIG. 1C, however, fanfold stack 502 may have optional additional creases or score lines at intermediate locations within stack 502.

In one example embodiment, for instance, fanfold stack 502 comprises a plurality of different layers of fanfold material 501. Each layer may be defined by opposing score lines 504*a*, 504*b*. In particular, score lines 504*a* may define the illustrated right side of the layers of packaging materials 501 as they are stacked in stack 502, while score lines 504*b* may define the illustrated left side of such layers. Between each right score line 504*a* and left score line 504*b*, there may one or more additional features. For example, the illustrated embodiment includes creases 512 formed between each of score lines 504*a*, 504*b*, although creases 512 may be folds, perforations, score lines, or other features that facilitate bending of raw materials 501 while maintaining stack 502 as a continuous series of connected panels and layers.

As will be appreciated in view of the disclosure herein, raw materials 501 may be fed into converting mechanism 510 using an infeed wheel 506 and infeed guides 508 in a manner similar to that previously described. Infeed wheel 506 may thus have a chord length or other size that allows infeed wheel 506 to engage raw materials 501 at locations other than at only score lines 504*a*, 504*b*. For example, in one embodiment, creases 512 are positioned within the layers of raw packaging materials 501 such that the distance between score lines 504*a*, 504*b* and creases 512 generally correspond to the chord length of infeed wheel 506. In other words, creases 512 may be pre-formed in packaging materials 501 such that infeed wheel 506 may engage creases as well as score lines in raw materials 501, but does not necessarily require that infeed wheel 506 create creases 512 as raw materials are fed around infeed wheel 506.

One aspect of pre-formed creases 512 is that they may improve the efficiency of converting machine 500. For example, pre-formed creases 512 may require less force to bend. As a result, infeed wheel 506 may exert reduced forces, which can also decrease the amount of power required in a motor or other drive mechanism. Further, it may allow for lighter-weight, more resilient, or other materials to be used in the manufacture of infeed wheel 506.

It will be noted that while FIG. 4 illustrates an exemplary converting machine 500 with an infeed wheel 506 that corresponds to the predetermined length between a crease 512 and a single score line 504*a* or 504*b*, this is merely exemplary. In other embodiments, multiple creases may be formed in a single layer, such that the length corresponds to a distance between creases 512. In still other embodiments, creases 512 may be formed merely to facilitate movement and flow of raw materials 501, and there may not be any direct integer relationship between the chord length of infeed wheel 506 and creases 512 and/or score lines 504*a*, 504*b*.

Figure 5:
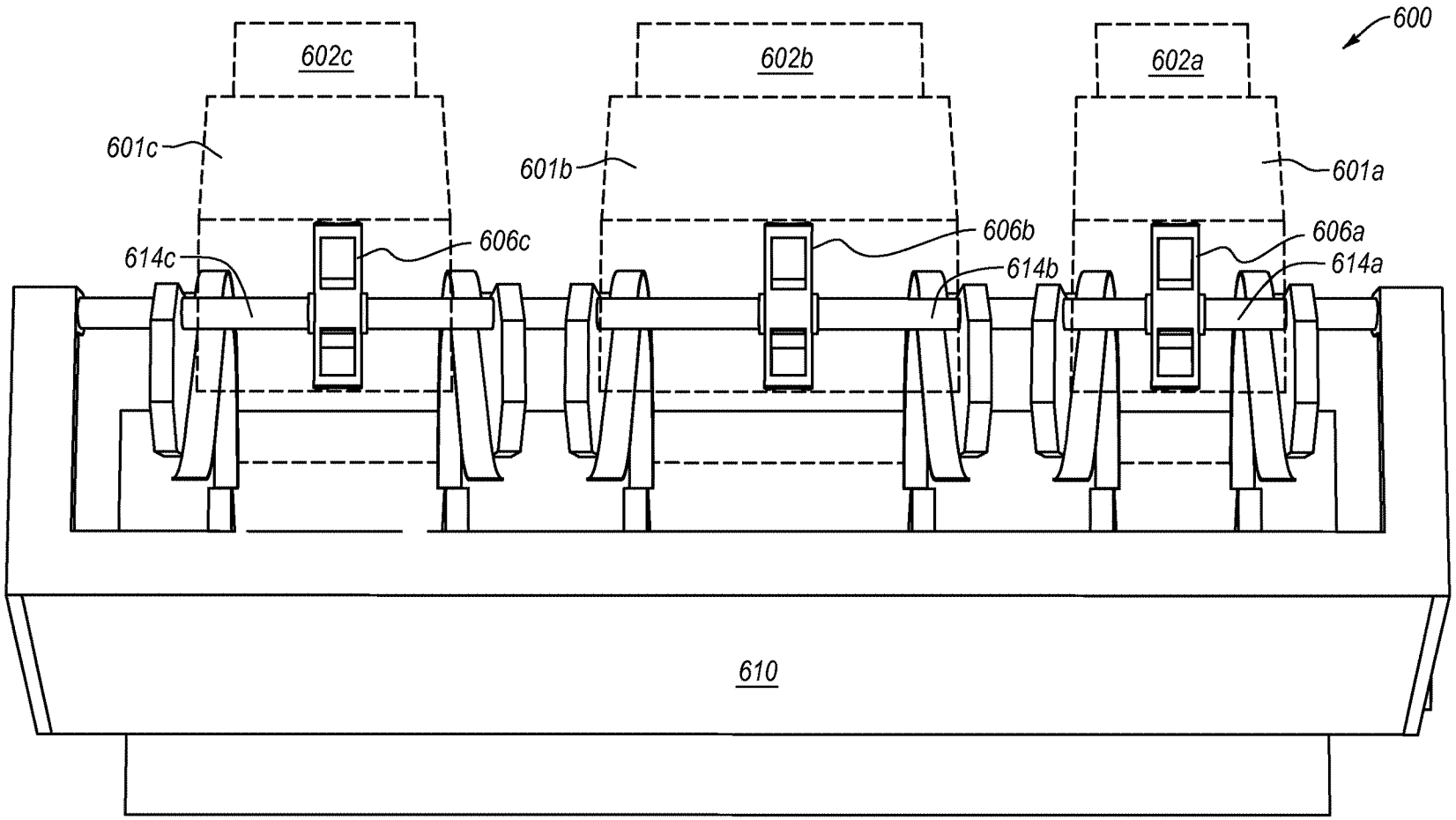
FIG. 5 illustrates an overhead view of an example converting machine capable of feeding packaging materials from three separate material stacks.

Turning now to FIG. 5, another exemplary converting machine 600 is illustrated. Converting machine 600 may generally operate in a manner similar to each of the converting machines and infeed systems described herein. Accordingly, one skilled in the art will appreciate that other aspects of converting machines, converting mechanisms, and infeed systems described herein are equally applicable to converting machine 600.

One aspect of converting machine 600 is that it has the ability to draw from multiple different reserves of raw materials 601*a*-601*c* to perform converting operations. For instance, in the illustrated embodiment, converting machine 600 may draw from any of three fanfold stacks 602*a*-602*c* to perform a converting operation, and without a manual or other adjustment be made to converting machine 600 to adapt it to a different size of raw materials 601. For example, while FIG. 1B illustrates a converting machine 100 that operates with a single size of raw materials 101, and which can be adjusted to accommodate another size of raw materials if necessary, Converting machine 600 may operate select one of three different sizes that are already configured to flow into converting mechanism 610, without any adjustment.

A converting machine may be adapted to select from any number of different sizes of raw materials 601*a*-601*c*, and need not necessarily have only three sizes that can be accommodated at a single time, as illustrated in FIG. 5. For example, in some cases, a single converting machine may have an infeed system that simultaneously couples converting mechanism 610 to only two different sizes of raw materials, or to four or more sizes of raw materials (e.g., up to twelve stacks or sizes at a single time).

Converting machine 610 may also be programmed or otherwise configured to select which of the different fanfold stacks 602*a*-602*c* is the desired stack for a particular operation. In operation, once a desired fanfold stack 602*a*-602*c* is determined, a drive mechanism (not shown) may cause a drive shaft 614*a*-614*c* corresponding to the desired stack to rotate. An infeed wheel 606*a*-606*c* may then be rotated by a particular drive shaft 614*a*-614*c*, and can feed raw materials 601*a*-601*c* in a manner similar to those described herein. In some cases, multiple infeed wheels 606*a*-606*c* may engage a single stack of raw materials. This may occur where, for example, raw materials have a large width and two or more infeed wheels can be used to more efficiently lift the materials and feed the materials into converting mechanism 610.

As will be appreciated in view of the disclosure herein, each of drive shafts 614*a*-614*c* and infeed wheels 606*a*-606*c* may thus be driven independently of the other drive shafts and infeed wheels, although this doesn't necessarily need to be the case. In one embodiment, drive shafts 614*a*-614*c* may be integrally formed, or otherwise coupled together, to collectively rotate. This may allow, for example, converting machine 600 to concurrently produce multiple packaging templates at a single time. Converting machine 600 may, for instance, have different sizes of fanfold stacks 602*a*-602*c* so that different configurations of packaging templates may be formed using concurrent converting operations, although in other cases, the same packaging templates may be formed from different sizes of stacks 602*a*-602*c*, or stacks 602*a*-602*c* may be of the same size and different or the same packaging templates may be concurrently formed therefrom.

As discussed herein, various embodiments of converting machines, converting mechanisms, and infeed systems are contemplated and within the scope of the present invention. The failure to identify and specifically address each potential feature of each embodiment should not, however, be construed as limiting the present invention to the illustrated embodiments or those described, but should rather encompass all aspects as may be learned by one skilled in the art upon review of the disclosure herein. Indeed, the various infeed systems described herein may interchangeably be used in connection a variety of different converting mechanisms, and each different feature of an infeed system may be interchanged with features of other infeed systems.

Furthermore, each converting machine and infeed system described herein, or learned upon a review of the disclosure herein, may be configured to handle a variety of different fanfold materials. In one example embodiment, the fanfold material is a corrugated board that is typically used in the production of boxes and packaging. In other example embodiments, the converting machine and the converting machine infeed system components may handle various other types of materials such as metals, fabrics, paper, plastics, composites, or the like.

As the type of material that is fed into the converting machine varies, the way in which the material is arranged before engaging the feed components of the converting machine may also vary. For example, the raw materials described herein are generally stacked in vertical stacks. In other embodiments, however, the raw materials may be otherwise aligned or situated. For instance, raw materials may be supplied from a horizontal stack of fanfold materials. In still other embodiments, raw materials may be fed on a roll. In any configuration, the infeed systems and converting machines described herein can use score lines, creases, folds, perforations, and the like that have been pre-formed in the raw material and/or create new creases or folds as the material is fed into a converting mechanism.

Moreover, a detailed description of the structure and operation of converting mechanisms is not considered critical to the understanding of the infeed system described herein, and should be understood by one skilled in the art. By way of example, a suitable converting mechanism may include multiple cutting, scoring, perforating, creasing, and/or other tools that are each individually controllable within the operative width of the converting mechanism. The tools may be supported on guides and controlled by a programmable control unit for individual, lateral positioning on the guides. Tool displacement may then be realized through an endless rotating belt to which tools are individually connected and disconnected. Such tools may also be individually controlled to engage the raw packaging materials for cutting and creasing operations. Such operations may be primarily performed in a feed direction through the converting mechanism. Other tools may, however, operate in a direction transverse to the feed direction. Such an embodiment is merely exemplary, however, and other converting mechanisms that operate in a wide variety of different manners may be utilized.

The invention is susceptible to various modifications and alternative means. Specific examples have been shown by way of example in the drawings and are described in detail herein. It should be understood, however, that the invention is not to be limited to the particular devices or methods disclosed. To the contrary, the invention is to cover all modifications, equivalents, and alternatives falling within the spirit and scope of the claims.

What is claimed is:

1. A feed system for feeding raw material into a converting machine, the feed system comprising:

a stack of fanfold material comprising a plurality of layers of fanfold material, each layer of fanfold material:

having a length extending between pre-formed boundary fold lines running along opposing outer edges of said stack of fanfold material, the lengths of said layers being equal to one another; and being planar and unfolded along its length between said pre-formed boundary lines when said plurality of layers are stacked on top of one another in said stack of fanfold material;

a rotatable infeed wheel comprising a plurality of radial members, a chord length between adjacent radial members being less than said length of each said layer of fanfold material, a ratio of said chord length and said length of each said layer of fanfold material being less than 1:1, said plurality of radial members engaging said layers at intermediate locations between said pre-formed boundary fold lines, wherein rotation of said infeed wheel draws said fanfold material from said stack, said infeed wheel engaging said layers as said fanfold material is drawn by said infeed wheel; and an infeed guide that receives said fanfold material from said infeed wheel, and, after engagement of said fanfold material with said infeed wheel, said infeed guide directs said fanfold material into a converting machine.

2. The feed system recited in claim 1, wherein said infeed guide has a radius of curvature requiring said fanfold material to bend at said intermediate locations between said pre-formed boundary fold lines.

3. The feed system recited in claim 1, wherein each layer of said plurality of layers contains at least one pre-formed crease between said pre-formed boundary fold lines, said at least one pre-formed crease being parallel to said boundary fold lines and being disposed between said opposing outer edges of said stack of fanfold material when said plurality of layers are stacked on top of one another in said stack of fanfold material.

4. The feed system recited in claim 1, wherein said fanfold material is fanfold corrugated board.

5. The feed system recited in claim 1, wherein said converting machine is configured to produce a converted package template using at least one conversion function from the group consisting of: cuts; creases; perforations, folds; and scores.

6. The feed system recited in claim 1, wherein said pre-formed boundary fold lines defining said layers are selected from a group consisting of creases, perforations, and scores.

7. The feed system recited in claim 1, wherein said plurality of radial members of said infeed wheel form a triangular shape.

8. The feed system recited in claim 1, wherein said chord length is half said length of each said layer of fanfold material.

9. The feed system of claim 1, wherein said infeed guide defines a path that causes said fanfold material to extend under an underside of said infeed wheel as said fanfold material is directed to said converting machine.

10. The feed system of claim 1, wherein said infeed wheel is powered to rotate in both forward and reverse directions.

11. The feed system recited in claim 1, wherein said plurality of layers are configured to be pulled off the stack in a fanfold fashion.

12. The feed system recited in claim 1, wherein each layer of the plurality of layers has a same number and positioning of pre-formed creases between said pre-formed boundary fold lines.

13. The feed system recited in claim 1, wherein said chord length is one-third said length of each said layer of fanfold material.

14. The feed system recited in claim 1, wherein said chord length is one-fourth said length of each said layer of fanfold material.

15. The feed system recited in claim 1, wherein said chord length is evenly dividable into said length of each said layer of fanfold material.

16. The feed system recited in claim 1, wherein the plurality of radial members engage the fanfold material near the center of the fanfold material between opposing sides of the fanfold material.

17. The feed system recited in claim 1, wherein the length of each layer of fanfold material extends between successive pre-formed boundary fold lines.

18. A converting system used to convert fanfold material into packaging templates for assembly into boxes or other packaging, the converting system comprising:

a stack of fanfold material formed of corrugated board, the stack of fanfold material comprising a plurality of layers of fanfold material, each layer of fanfold material having a length extending between successive pre-formed boundary fold lines running along opposing outer edges of said stack of fanfold material, the lengths of said layers being equal to one another;

an infeed wheel that rotates and, while rotating, engages: (i) said pre-formed boundary fold lines in said fanfold material, and (ii) at one or more intermediate locations disposed between said pre-formed boundary fold lines, said infeed wheel comprising:

at least three radial members, said at least three radial members being equally spaced apart and having a chord length between adjacent radial members, said chord length being a linear distance between radially distant edges of adjacent radial members, said chord length being less than said length of each said layer of fanfold material between successive pre-formed boundary fold lines, said chord length being evenly dividable into said length of each said layer of fanfold material;

a drive mechanism that draws said fanfold material from said stack of fanfold material with a corresponding rotation of said infeed wheel in at least a forward direction;

an infeed guide that receives said fanfold material from said infeed wheel and changes an orientation of said fanfold material from a vertical position to a horizontal position around a radius portion of said infeed guide, wherein said radius portion of said infeed guide bends said fanfold material at one or more intermediate locations between said pre-formed boundary fold lines in said stack of fanfold material; and a converting mechanism that receives said fanfold material from said infeed guide and performs at least one conversion function thereon to create the packaging template.

19. The converting system of claim 18, wherein said drive mechanism:

causes said infeed wheel to rotate in said forward direction, wherein said rotation of said infeed wheel in said forward direction causes said fanfold material to move toward said converting mechanism; or causes said fanfold material to be drawn into said converting mechanism, wherein drawing of said fanfold material into said converting mechanism causes said infeed wheel to rotate in said forward direction, and said fanfold material to be lifted from said stack of fanfold material.

20. The converting system of claim 18, wherein said drive mechanism is configured to cause said fanfold material to be drawn away from said converting mechanism in order to perform the at least one conversion function.

21. The converting system of claim 18, wherein said infeed wheel engages said fanfold material and lifts said fanfold material off of said stack of fanfold material, said stack of fanfold material being positioned proximate to said infeed guide to limit entry between said stack of fanfold material and said infeed guide.

22. The converting system of claim 18, wherein said infeed guide is made from a low friction material or is coated with a low friction material.

23. The converting system of claim 18, wherein each layer of the plurality of layers contains at least one pre-formed crease between said pre-formed boundary fold lines, said at least one pre-formed crease being parallel to said boundary fold lines and being disposed between said opposing outer edges of said stack of fanfold material when said plurality of layers are stacked on top of one another in said stack of fanfold material.

24. The converting system of claim 18, comprising a plurality of infeed wheels and a plurality of infeed guides, wherein said plurality of infeed wheels and said plurality of infeed guides are configured to independently feed raw materials from a plurality of different stacks.

25. The converting system recited in claim 18, wherein said chord length is one-third said length of each said layer of fanfold material.

26. The converting system recited in claim 18, wherein said chord length is one-fourth said length of each said layer of fanfold material.

27. The converting system recited claim 18, wherein each layer of fanfold material is planar and unfolded along its length between successive pre-formed boundary lines when said plurality of layers are stacked on top of one another in said stack of fanfold material.

28. The converting system recited in claim 18, wherein the radially distant edges of the radial members engage a major surface of the fanfold material.

* * * * *